United States Patent [19]

Inagaki et al.

[11] Patent Number: 4,903,659

[45] Date of Patent: Feb. 27, 1990

[54] CARBURETOR CONTROLLING APPARATUS FOR COMBUSTION ENGINE

[75] Inventors: Makoto Inagaki, Hamamatsu; Shoichi Yamaguchi, Hamana; Fujiyuki Suzuki, Hamamatsu, all of Japan

[73] Assignee: Suzuki Jidosha Kogyo Kabushiki Kaisha, Shizuoka, Japan

[21] Appl. No.: 184,241

[22] Filed: Apr. 21, 1988

[30] Foreign Application Priority Data

Apr. 29, 1987 [JP] Japan ..... 62-65588[U]

[51] Int. Cl.[4] ..... F02M 3/06

[52] U.S. Cl. ..... 123/339

[58] Field of Search ..... 123/325, 326, 339

[56] References Cited

U.S. PATENT DOCUMENTS 3,297,103 1/1967 Walker ..... 123/325
4,462,355 7/1984 Ozaki et al. ..... 123/325

FOREIGN PATENT DOCUMENTS 54-31833 3/1979 Japan ..... 123/325
55-5437 1/1980 Japan .
56-60847 5/1981 Japan ..... 123/325
58-42590 9/1983 Japan .

*Primary Examiner*—Andrew M. Dolinar
*Attorney, Agent, or Firm*—Flynn, Thiel, Boutell & Tanis

[57] ABSTRACT

An apparatus for controlling a carburetor of a combustion engine includes: a throttle-opening detector switch for detecting that a throttle valve of the carburetor is opened within a predetermined degree of throttle opening; an idle-up mechanism for making the throttle valve perform an idling-up operation; a fuel-cut mechanism for cutting a slow speed fuel supply of the carburetor; and a control unit adapted to allow the idle-up mechanism to perform the idling-up operation under a predetermined load applied to the engine and allow the fuel-cut mechanism to cut the slow speed fuel supply at a reduced speed of the engine when the throttle-opening detector switch detects that the throttle valve of the carburetor is within the predetermined degree of throttle opening. The control unit also includes an arrangement responsive to detection that the throttle valve is not within the predetermined range for inhibiting the idle-up mechanism.

9 Claims, 2 Drawing Sheets

FIG. 1
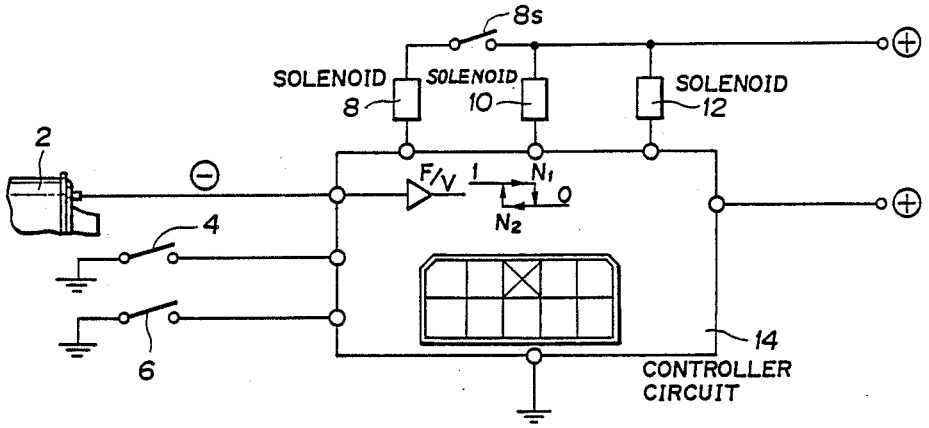
FIG. 2
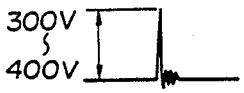
FIG. 3
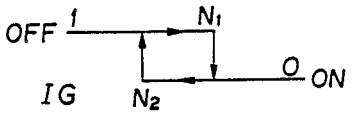
FIG. 4
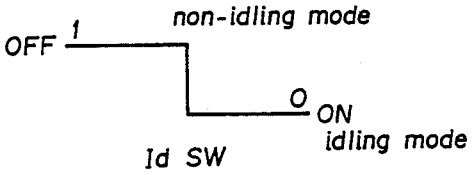
FIG. 5
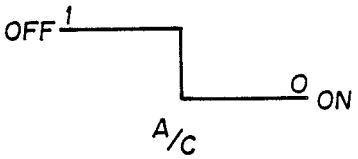
FIG. 6
| IG | 0 | 0 | 1 | 1 |
|---|---|---|---|---|
| Idsw | 0 | 1 | 0 | 1 |
| OUTPUT TO SOLENOID 12 | 1 | 0 | 0 | 0 |
FIG. 7
| Idsw | 1 | 0 |
|---|---|---|
| OUTPUT TO SOLENOID 8 | 1 | 0 |
FIG. 8
| Idsw | 0 | 0 | 1 | 1 |
|---|---|---|---|---|
| A/C | 0 | 1 | 0 | 1 |
| OUTPUT TO SOLENOID 10 | 0 | 1 | 1 | 1 |

CARBURETOR CONTROLLING APPARATUS FOR COMBUSTION ENGINE

FIELD OF THE INVENTION

The present invention relates to an apparatus for controlling a carburetor for a combustion engine and, more particularly, to a carburetor controlling unit for the combustion engine which prevents an improper operation of a fuel-cut mechanism due to an improper setting of the degree of throttle opening for an idling-up operation by an idle-up mechanism to thereby protect an emission control catalyzer from being burned.

BACKGROUND OF THE INVENTION

Recently, some combustion engines have been controlled to idle at a reduced rotational speed for the purpose of emission control or reduction of fuel consumption. With the combustion engine operating at such an idle rotation set at such a reduced value, the rotational speed will decrease to cause an improper operating condition when the engine is subjected to a small amount of load caused for example by an electric load of a headlight, actuation of an air compressor for an air conditioning unit, or circulation of cooling water to cool a heat exchanger of a heater. To avoid this, some combustion engines have an idle-up mechanism for opening a throttle valve of a carburetor to increase an idle speed. (See Japanese Patent Laid-Open Publication 55-5437).

There is known another combustion engine which is provided with a fuel-cut mechanism for cutting a slow speed fuel flow for the carburetor to prevent an over-fuel condition of the air-fuel ratio during a reduced speed operation. (See Japanese Utility Model Publication 58-42590).

It has been a customary practice that such idle-up and fuel-cut mechanisms are operated independently. The fuel-cut mechanism operates when a throttle-opening detector switch detects that the carburetor throttle valve is opened within a predetermined degree of throttle opening during the reduced speed operation of the engine.

However, the throttle-opening detector switch is kept detecting that the throttle valve is opened beyond the predetermined degree of throttle opening if the degree of throttle opening for idle-up is wrongly set to a value greater than the predetermined degree monitored by the detector switch. In this case, the fuel-cut mechanism fails to cut the slow speed fuel flow, thus causing an improper operation thereof, with the result that an air-fuel mixture of an objectionable over-fuel ratio is supplied to the engine and produces incomplete combustion gases, which in turn will mingle with the emission control catalyzer to cause an objectionable burning of the latter.

OBJECT OF THE INVENTION

It is therefore an object of the present invention to provide an apparatus for controlling a carburetor of a combustion engine, wherein the fuel-cut mechanism is kept free from an improper operation due to wrongly setting the degree of throttle valve opening effected by the idle-up mechanism, for thereby preventing burning of the emission control catalyzer due to an improper fuel-cut operation.

SUMMARY OF THE INVENTION

To achieve the foregoing object, the present invention provides a control unit which includes a throttle-opening detector switch for detecting that a throttle valve of the carburetor is opened within a predetermined degree of throttle opening; an idle-up mechanism for making the throttle valve perform an idling-up operation; a fuel-cut mechanism for cutting a slow speed fuel flow of the carburetor; and a control unit adapted to cause the idle-up mechanism to perform the idling-up operation under a predetermined load applied to the engine and to cause the fuel-cut mechanism to cut the slow speed fuel supply at a reduced speed of the engine when the throttle-opening detector switch detects that the throttle valve of the carburetor is within the predetermined degree of throttle opening. The control unit also includes an arrangement responsive to detection that the throttle valve is not within the predetermined range for inhibiting the idle-up mechanism.

According to the present invention, the idling-up operation for opening the throttle valve is controlled to be within the predetermined degree of throttle opening even when the throttle opening is set at a wrong value greater than the predetermined degree, because the control unit is adapted to allow the idle-up mechanism to perform the idling-up operation under a predetermined load applied to the engine when the throttle-opening detector switch detects that the throttle valve of the carburetor is within the predetermined degree of throttle opening. With this arrangement, the throttle-opening detector switch will detect that the throttle valve of the carburetor is within the predetermined degree of throttle opening, thus preventing an objectionable improper operation of the fuel-cut mechanism caused by a wrong set value of the throttle opening.

BRIEF DESCRIPTION OF THE DRAWINGS

FIGS. 1–8 show a first embodiment of the present invention: FIG. 1 is a diagram of a control unit; FIGS. 2–5 show wave patterns of signals; and FIGS. 6–8 are explanary views showing the manner in which the system operates.

Figure 9:
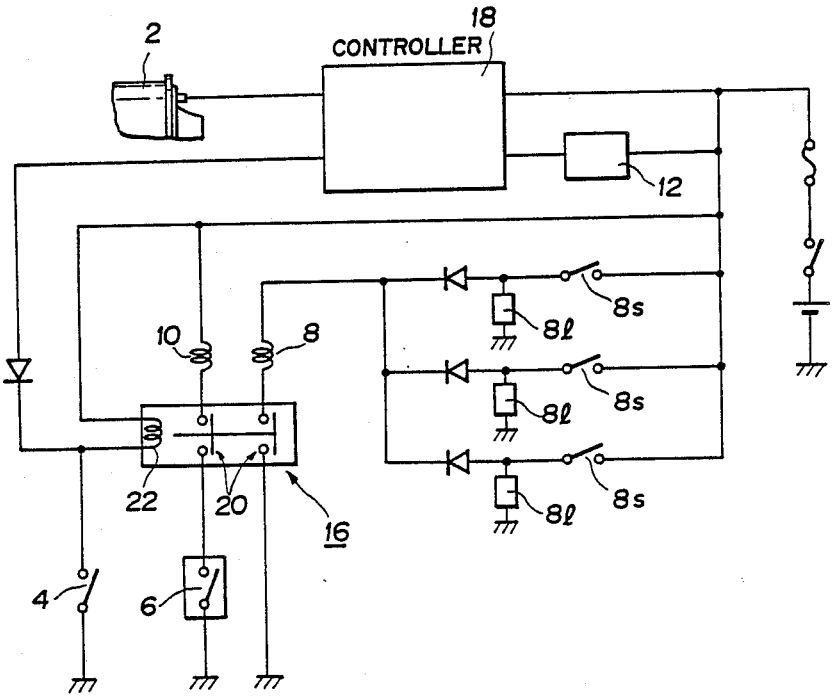
FIG. 9 is a diagram of a control unit according to a second embodiment of the invention.

In the drawings, reference numeral 2 designates an ignition unit; 4 a throttle-opening detector switch; 6 an air conditioner switch; 8 an electric load idle-up solenoid constituting a component of an idle-up mechanism; 10 an air conditioner idle-up solenoid constituting a component of the idle-up mechanism; 12 a fuel-cut solenoid constituting a component of a fuel-cut mechanism; 14 a controller circuit forming a control unit; 16 a controller switch; 18 a control contact; and 22 a controller solenoid.

DETAILED DESCRIPTION

With reference to the accompanying drawings, the present invention is described hereinbelow.

FIGS. 1–8 show a first embodiment of the present invention.

In the drawings, reference number 2 designates an ignition unit; 4 a throttle-opening detector switch; 6 an air conditioner switch; 8 an electric load idle-up solenoid constituting a component of an idle-up mechanism; 10 an air conditioner idle-up solenoid constituting a component of the idle-up mechanism; 12 a fuel-cut solenoid 12 constituting a component of a fuel-cut mechanism; and 14 a controller circuit forming a control unit.

Connected to inputs of the controller circuit 14 are the ignition unit 2, the throttle-opening detector switch 4, and the air conditioner switch 6. The ignition unit 2 enters an ignition signal shown in FIG. 2 into the controller circuit 14. The controller circuit 14 detects the rotational speed of the engine from the ignition signal, and records a rotational speed of less than a predetermined value N1 as an OFF value of signal IG and a rotational speed of more than a predetermined value N2 as an ON value of signal IG, with hysteresis as shown in FIG. 3. The throttle-opening detector switch 4 detects whether a not-illustrated carburetor throttle valve of the combustion engine is opened within a predetermined degree to thereby send an ON value of signal IdSW to the controller circuit 14 when the throttle valve is opened within the predetermined degree and an OFF value of signal IdSW when it is opened more than the predetermined degree, as shown in FIG. 4. The air conditioner switch 6 sends an ON value of signal A/C to the controller circuit 14 when the not-illustrated air conditioner is in operation and an OFF value of signal A/C when the air conditioner is not in operation, as shown in FIG. 5.

Connected to outputs of the controller circuit 14 are the electric load idle-up solenoid 8, the air conditioner idle-up solenoid 10, and the fuel-cut solenoid 12. If an electric load such as the headlights is applied when the controller circuit 14 sends an ON signal to the electric load idle-up solenoid 8, the carburetor throttle valve is further opened to perform an idling-up operation. The controller circuit 14 also sends an ON signal to the air conditioner idle-up solenoid 10 for further opening the carburetor throttle valve to perform an idling-up operation when switch 6 indicates the air compressor for the air conditioner is in operation. The controller circuit 14 sends an OFF signal to the fuel-cut solenoid 12 to partially cut the fuel supply at the time of a reduced speed operation.

Referring now to FIGS. 6–8, operation of the first embodiment will be described. In FIGS. 6–8, an ON signal and OFF signal are depicted as '0' and '1', respectively.

With the throttle valve regulated to be open within the predetermined degree of idle throttle opening at the time of a reduced speed operation of the combustion engine, when the controller circuit 14 receives a '0' value of signal IG (FIG. 6) upon detection of a rotational speed of more than a predetermined rotation value N2 from the ignition signal, it sends a '1' signal to the fuel-cut solenoid 12 to cut the slow speed fuel flow when the controller circuit 14 also receives a '0' value of signal IdSW from the throttle-opening detecting switch 4, thus preventing the combustion engine from exhausting incomplete combustion gases at the time of the reduced speed operation.

When the controller circuit 14 receives a '1' value of signal IG from the ignition unit 2 or of signal IdSW from the throttle-opening detecting switch 4, the controller circuit sends a '0' to the fuel-cut solenoid 12 so as to refrain from cutting the slow speed fuel flow, as shown in FIG. 6.

The controller circuit 14 controls the idling-up operation of the idle-up mechanism depending on the signals which the controller circuit 14 receives from the throttle-opening detecting switch 4 and the air conditioner switch 6. More particularly, upon receiving a '0' value of signal IdSW from the throttle-opening detecting switch 4, as shown in FIG. 7, the controller circuit 14 sends a –0' signal the electric load idle-up solenoid 8 to enable an idling-up operation. When during this operation an electric load switch 8*s* is turned on, or when a '0' value of the signal A/C is received from the air conditioner switch 6 and solenoid 10 is actuated, the throttle valve for the carburetor is opened up to such a degree as is appropriate for the idling-up operation. If the throttle valve is opened up to a degree which is more than the predetermined degree monitored by the switch 4, the controller circuit 14 receives a '1' signal from the throttle-opening detecting switch 4, and deactuates solenoids 8 and 10 to prohibit the idling-up operation.

Thus the controller circuit 14 permits the idling-up operation of the idle-up mechanism and causes the throttle valve to open by the degree of idle-up opening when the controller circuit 14 receives a '0' value of signal IdSW from the throttle-opening detecting switch 4 and when either the electric load switch 8*s* is turned on or a '0' value of signal A/C is received from the air conditioner switch 6. Therefore, the idling-up operation of the idle-up mechanism is not permitted when the idle-up throttle valve opening is not within the predetermined degree of throttle opening monitored by switch 4, for example when it exceeds the predetermined degree of opening. The idle-up mechanism thus is controlled to perform a suitable idling-up operation.

With this arrangement, if the degree of the idle-up throttle opening is wrongly adjusted with an adjusting screw to a value greater than the predetermined degree of throttle opening, the throttle-opening detecting switch 4 serves to regulate the idling-up operation of the throttle valve so that the valve is within the predetermined degree of idle-up opening. The throttle-opening detecting switch 4 is kept in a state detecting that the throttle valve is opened within the predetermined degree of throttle idle opening, thereby preventing an improper operation of the fuel-cut mechanism due to an inadequate setting of the degree of idle-up throttle opening for the idle-up mechanism.

This arrangement thus prevents emission of incomplete combustion gases due to an over-fuel ratio of the air-fuel mixture caused by improper operation of the fuel-cut mechanism. This means the objectionable burning of the emission control catalyzer caused by incomplete combustion gases supplied into the catalyzer is also prevented.

The first embodiment employs a logic control system which makes the mechanism simple in construction and enables a central control system.

FIG. 9 shows a second embodiment of the present invention.

In FIGS. 1 and 9, similar reference numerals are used to indicate similar components. In FIG. 9, reference numeral 2 designates an ignition unit; 4 a throttle-opening detector switch; 6 an air conditioner switch; 8 an electric load idle-up solenoid constituting a component of an idle-up mechanism; 10 an air conditioner idle-up solenoid constituting a component of the idle-up mechanism; 12 a fuel-cut solenoid constituting a component of a fuel-cut mechanism; 16 a controller switch forming a control unit; and 18 a fuel-cut controller.

Connected to inputs of the fuel-cut controller 18 are the ignition unit 2, and the throttle-opening detector switch 4. Connected to an output of the fuel-cut controller 18 is the fuel-cut solenoid 12, which in turn is connected to a power source. Connected to one end to the fuel-cut solenoid 12 and in parallel with each other are the electric load idle-up solenoid 8 having various electric load switches 8*s* connected in parallel for turning on and off respective electric loads 8*l*, and the air conditioner idle-up solenoid 10. The electric load idle-up solenoid 8 has its other end connectible to ground via the controller switch 16, while the air conditioner idle-up solenoid 10 has its other end connectible to ground via the controller switch 16 and the air conditioner switch 6. A controller solenoid 22 serves to open and close a control contact 20 of switch 16, and has a positive terminal connected to one end of the air conditioner idle-up solenoid 10 and a negative terminal connected to one end of the throttle-opening detecting switch 4.

With this arrangement, when the throttle-opening detecting switch 4 is detecting the idle throttle opening to be within the predetermined degree and is turned on, the controller switch 16 feeds electric current to the controller solenoid 22 to close the control contact 20 for thereby making each of the electric load idle-up solenoid 8 and the air conditioner idle-up solenoid 10 conductive. On the other hand, when the throttle-opening detecting switch 4 detects a throttle opening of more than the predetermined degree of idle throttle opening and is turned off, the controller switch 16 cuts the electric current to the controller solenoid 22 to open the control contact 20 for thereby making the electric load idle-up solenoid 8 and the air conditioner idle-up solenoid 10 nonconductive.

Operation of the second embodiment is described hereinbelow.

When the throttle opening of the throttle valve is within the predetermined degree of idle throttle opening as the engine is operated at a reduced speed, the fuel-cut controller 18 receives from the ignition unit 2 the ignition signal indicating the rotation of less than the predetermined rotation value and also receives an ON signal from the throttle-opening detecting switch 4, whereupon the ON signal from the latter causes the controller solenoid 22 of the controller switch 16 to be supplied with the electric current. This current flow causes the fuel-cut solenoid 12 to cut the slow speed fuel flow to thereby prevent incomplete combustion gases from being exhausted from the engine operated at the reduced speed.

On the other hand, when the fuel-cut controller 18 receives an OFF signal from the throttle-opening detecting switch 4, the electric current to the controller solenoid 22 of the controller switch 16 is cut off to thereby open the control contact 20 due to the OFF condition of the throttle-opening detecting switch 4, even though the fuel-cut controller 18 receives the signal of less than the predetermined rotation value from the ignition unit 2. With this operation, the fuel-cut solenoid 12 does not cut the slow speed fuel flow.

The controller switch 16 controls the idling-up operation of the idle-up mechanism depending on the ON/-OFF signal from the throttle-opening detecting switch 4. More particularly, when the degree of throttle opening falls within the predetermined degree of the idle opening and thus the throttle-opening detecting switch 4 is turned on, the electric current is fed to the controller solenoid 22 of the controller switch 16 to thereby close the control contact 20, thus making the electric load idle-up solenoid 8 and the air conditioner idle-up solenoid 10 conductive. Consequently, with the air conditioner switch 6 turned on or with at least one of the electric load switches 8*s* turned on, the electric load idle-up solenoid 8 or the air conditioner idle-up solenoid 10 are fed with electric current so as to open the throttle valve up to the degree of idling-up opening.

When the opening of the throttle valve is greater than the predetermined degree of idle-up opening and thus the throttle-opening detecting switch 4 is turned off, the electric current to the controller solenoid 22 of the controller switch 16 is cut off to open the control contact 20 to thereby make the electric load idle-up solenoid 8 and the air conditioner idle-up solenoid 10 become nonconductive. As a result, the idling-up operation is not effected by the electric load idle-up solenoid 8 or the air conditioner idle-up solenoid 10.

As described hereinabove, the controller switch 16 permits the idle-up mechanism to effect the idle-up operation when the electric load switch 8*s* is turned on or the air conditioner switch 6 is turned on with the ON signal received from the throttle-opening detecting switch 4, for thereby opening the throttle valve to the predetermined degree of idle-up opening. If the throttle valve is not at the idle-up opening, or in other words the throttle valve is opened more than the predetermined degree of the idle-up opening, the idling-up operation is not performed. This system makes the idle-up mechanism perform the idling-up operation of the throttle valve in a suitable manner.

Accordingly, even when the idling-up opening of the throttle valve is wrongly adjusted by the adjusting screw to become greater than the predetermined degree of the idle throttle opening, the throttle-opening detecting switch 4 serves to regulate the throttle valve such that the throttle valve is idled up within the predetermined degree of the throttle opening. The throttle-opening detecting switch 4 is thus kept detecting that the throttle valve is opened at the predetermined degree of the idle-up opening, thereby preventing the improper operation of the fuel-cut mechanism due to setting the degree of the idle-up opening at a wrong value.

This arrangement thus prevents emission of the incomplete combustion gas due to an over fuel ratio of the air-fuel mixture caused by improper operation of the fuel-cut mechanism. This means the objectionable burning of the emission control catalyzer which is caused by the incomplete combustion gas supplied into the catalyzer is also prevented.

According to the second embodiment, the system has a circuit which is simple in construction, and enables a dual-control of idling-up and fuel-cut operations.

According to the present invention, the idling-up operation for opening the throttle valve is controlled to be within the predetermined degree of throttle opening even when the idle-up throttle opening position is set at a wrong value which is greater than such predetermined degree, because the control unit is adapted to allow the idle-up mechanism to perform the idling-up operation under a predetermined load applied to the engine when the throttle-opening detector switch detects that the throttle valve of the carburetor is at the predetermined degree of throttle opening. With this arrangement, the throttle-opening detector switch will detect that the throttle valve of the carburetor is within the predetermined degree of throttle-opening, thus preventing the improper operation of the fuel-cut mechanism caused by the wrong set value of the throttle opening.

This arrangement thus prevents emission of incomplete combustion gases due to an over-fuel ratio of the air-fuel mixture caused by improper operation of the fuel-cut mechanism. This means the objectionable burning of the emission control catalyzer caused by incomplete combustion gases supplied into the catalyzer is also prevented.

The embodiments of the invention in which an exclusive property or privilege is claimed are defined as follows:

1. An apparatus for controlling a carburetor of a combustion engine, comprising: throttle-opening detector switch means for detecting that a throttle valve of said carburetor is opened within a predetermined degree of throttle opening; idle-up means for making said throttle valve perform an idling-up operation; fuel-cut means for cutting a slow speed fuel supply to said carburetor; and control means for causing said idle-up means to perform the idling-up operation in response to a predetermined load applied to the engine and for causing said fuel-cut means to cut the slow speed fuel flow during a reduced speed condition of the engine when said throttle-opening detector switch means detects that said throttle valve of said carburetor is within the predetermined degree of throttle opening, said control means further including means responsive to detection by said switch means that said throttle valve is opened farther than said predetermined degree for inhibiting said idle-up means from performing said idling-up operation.

2. An apparatus according to claim 1, including a load switch which actuates said predetermined load when closed, and wherein said idle-up means include a solenoid connected in series with said switch between said control means and a source of power, said idle-up means performing said idling-up operation in response to energization of said solenoid.

3. An apparatus according to claim 1, wherein said predetermined load is an air conditioner, including a switch which actuates said air conditioner when closed and is connected to an input of said control means, and wherein said idle-up means includes a solenoid which is connected between said control means and a source of power, said idle-up means performing said idling-up operation in response to energization of said solenoid.

4. An apparatus according to claim 1, including a controller switch which is responsive to said detector switch means and closes while said detector switch means is detecting that said throttle valve is opened within said predetermined degree, including an air conditioner and an air conditioner switch which actuates said air conditioner when closed, and wherein said idle-up means includes a solenoid and performs said idling-up operation in response to actuation of said solenoid, said air conditioner switch, said controller switch and said solenoid being connected in series with each other between ground and a source of power.

5. An apparatus according to claim 1, including a controller switch which is responsive to said detector switch means and closes while said detector switch means is detecting that said throttle switch is opened within said predetermined degree, including a load switch which actuates said predetermined load when closed, and wherein said idle-up means includes a solenoid and performs said idling-up operation in response to actuation of said solenoid, said controller switch, said load switch and said solenoid being connected in series with each other between ground and a source of power.

6. An apparatus according to claim 5, including a further load switch which actuates a further load when actuated and which is connected in parallel with said first-mentioned load switch.

7. An apparatus for controlling the engine, comprising: throttle means for selectively controlling fuel flow to the engine, said throttle means varying the rate of flow of fuel within a range bounded by a first rate of substantially free fuel flow and a second rate of substantially inhibited fuel flow; detecting means for detecting a condition in which said throttle means is set to permit fuel flow at a third rate less than said first rate and greater than said second rate; idel-up means responsive to a predetermined event which increases the load on the engine for causing said throttle means to be set to permit fuel flow at a fourth rate less than said first rate and greater than said second rate; and means responsive to said detecting means for disabling said idle-up means when said throttle means is set to permit fuel flow at a rate greater than said third rate.

8. An apparatus according to claim 7, wherein said idle-up means includes means for facilitating adjustment of said fourth rate of fuel flow.

9. An apparatus according to claim 8, including fuel cut means for reducing a fuel flow during a predetermined operating condition which includes said detecting means detecting that said throttle means is set to permit fuel flow a rate between said second and third rates.

* * * * *

UNITED STATES PATENT AND TRADEMARK OFFICE

CERTIFICATE OF CORRECTION

PATENT NO. : 4 903 659

DATED : February 27, 1990

INVENTOR(S) : Makoto INAGAKI et al

It is certified that error appears in the above-identified patent and that said Letters Patent is hereby corrected as shown below:

Column 8, line 31; change "idel-up" to ---idle-up---.
line 46; after "flow" insert ---at---.

Signed and Sealed this

Twenty-fourth Day of September, 1991

*Attest:*

HARRY F. MANBECK, JR.

*Attesting Officer*

*Commissioner of Patents and Trademarks*